US008651182B2

(12) United States Patent
Fay et al.

(10) Patent No.: US 8,651,182 B2
(45) Date of Patent: Feb. 18, 2014

(54) DOG WITH SKIRT TO TRANSFER HOUSING LOADS IN A SUBTERRANEAN TOOL

(75) Inventors: Peter J. Fay, Houston, TX (US); Marcus A. Avant, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 366 days.

(21) Appl. No.: 13/013,586

(22) Filed: Jan. 25, 2011

(65) Prior Publication Data

US 2012/0186806 A1 Jul. 26, 2012

(51) Int. Cl.
*E21B 23/02* (2006.01)

(52) U.S. Cl.
USPC ..... 166/217; 166/208; 166/382

(58) Field of Classification Search
USPC ..... 166/208, 217, 382
See application file for complete search history.

(56) References Cited

U.S. PATENT DOCUMENTS

| | | | | | |
|---|---|---|---|---|---|
| 2,623,593 | A * | 12/1952 | Pennington et al. | ..... | 166/217 |
| 2,698,056 | A * | 12/1954 | Marshall et al. | ..... | 166/123 |
| 3,135,329 | A * | 6/1964 | Conrad | ..... | 166/237 |
| 3,142,339 | A * | 7/1964 | Brown et al. | ..... | 166/122 |
| 4,051,896 | A * | 10/1977 | Amancharla et al. | ..... | 166/123 |
| 4,161,984 | A * | 7/1979 | Watkins | ..... | 166/382 |
| 4,396,061 | A * | 8/1983 | Tamplen et al. | ..... | 166/217 |
| 4,436,152 | A * | 3/1984 | Fisher et al. | ..... | 166/214 |
| 4,603,743 | A * | 8/1986 | Lindsey, Jr. | ..... | 166/382 |
| 4,651,818 | A * | 3/1987 | Johnson et al. | ..... | 166/115 |
| 4,811,785 | A * | 3/1989 | Weber | ..... | 166/117.7 |
| 4,896,721 | A * | 1/1990 | Welch | ..... | 166/214 |
| 5,000,265 | A * | 3/1991 | Pleasants et al. | ..... | 166/387 |
| 5,390,735 | A * | 2/1995 | Williamson, Jr. | ..... | 166/115 |
| 5,409,059 | A * | 4/1995 | McHardy | ..... | 166/208 |
| 5,538,082 | A * | 7/1996 | Zwart | ..... | 166/382 |
| 6,382,323 | B1 * | 5/2002 | Gano et al. | ..... | 166/382 |
| 6,497,288 | B2 * | 12/2002 | George et al. | ..... | 166/377 |
| 6,568,480 | B2 * | 5/2003 | Dewey | ..... | 166/382 |
| 7,036,602 | B2 * | 5/2006 | Turley et al. | ..... | 166/387 |
| 7,373,988 | B2 * | 5/2008 | Campbell et al. | ..... | 166/377 |
| 2012/0186804 | A1 * | 7/2012 | Fay et al. | ..... | 166/216 |
| 2012/0186805 | A1 * | 7/2012 | Fay et al. | ..... | 166/240 |
| 2012/0186806 | A1 * | 7/2012 | Fay et al. | ..... | 166/240 |

* cited by examiner

*Primary Examiner* — Jennifer H Gay
(74) *Attorney, Agent, or Firm* — Steve Rosenblatt

(57) ABSTRACT

A plurality of rows of locking dogs are provided with housing flexibility between rows to allow them to share a shear loading while leaving enough structural integrity in the housing to define the windows through which the dogs emerge. The dogs can also have extensions with a surface that grippingly engages the housing adjacent the window on extension of the dogs such that loads can transfer from the housing into the extension and into the profile in which the dog is disposed rather than passing the shear stress through the window edge into the dog that is in the profile. The dog configuration can also share the load on multiple contact surfaces of the housing to reduce stress at each contact location.

9 Claims, 5 Drawing Sheets

DOG WITH SKIRT TO TRANSFER HOUSING LOADS IN A SUBTERRANEAN TOOL

FIELD OF THE INVENTION

The field of the invention is lock mandrels that engage a mating profile in a tubular with dogs and more particularly design features that distribute shear loads on the dogs when stacked or that transfer loads on the housing between dog windows to the dogs from the adjacent body portion to reduce stress otherwise passing to the housing portions between dog windows.

BACKGROUND OF THE INVENTION

FIGS. 1-3 show an existing design for a lock mandrel tool 10 that has an outer housing 14 with openings 16 for extendable dogs 18 shown retracted in FIG. 1. One or more seals 20 engage a seal bore in a surrounding tubular that is not shown when the tool 10 hits a no-go also not shown in the surrounding tubular. A setting sleeve 22 has a thin lower end 24 that is under the dogs 18 for run in so that dogs 18 will be retracted inside windows 16. A ramp 26 leads to a larger diameter portion 28. As seen in FIG. 2 when the ramp 26 is pushed against the dogs 18 the dogs 18 get pushed out through the windows 16 to the point where portion 28 underlies the dogs 18 and the dogs 18 are extended into a surrounding profile that is not shown. The extension of the dogs 10 raises the tool 10 off the no-go that is not shown.

Housing 14 has elongated segments 30 that define the windows 16 between them. There needs to be sufficient wall in segments 30 so that when there is a pressure differential from uphole and the dogs 18 are extended into a surrounding profile and the tool 10 as a result of dog extension is no longer supported on the no-go, that the tensile stress in the segments 30 is not exceeded. There is normally a tradeoff between making the dogs 18 wider and the need for sufficient wall thickness to tolerate the stresses administered from pressure differential. Wider dogs 18 can hold more shear load but the strength of the body is reduced when the width of segments 30 is reduced to make the dogs 18 wider.

The present invention addresses this issue in at least two ways that can be used separately or together. In one aspect the load is transferred to the dogs from the housing while avoiding or minimizing loading the window periphery and the sections of the housing that are among the windows. In another approach multiple rows of dogs are presented to share the shear loading and flexibility in the housing between rows of dogs allows the sharing of shear loading. This addresses an issue of manufacturing tolerances being high enough so that engagement of a first row of dogs can move another row of dogs into a position where they do not take the shear loading at all because they are displaced from the profile end. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A plurality of rows of locking dogs are provided with housing flexibility between rows to allow them to share a shear loading while leaving enough structural integrity in the housing to define the windows through which the dogs emerge. The dogs can also have extensions with a surface that grippingly engages the housing adjacent the window on extension of the dogs such that loads can transfer from the housing into the extension and into the profile in which the dog is disposed rather than passing the shear stress through the window edge into the dog that is in the profile. The dog configuration can also share the load on multiple contact surfaces of the housing to reduce stress at each contact location.

DETAILED DESCRIPTION OF THE PREFERRED EMBODIMENT

Figure 4:
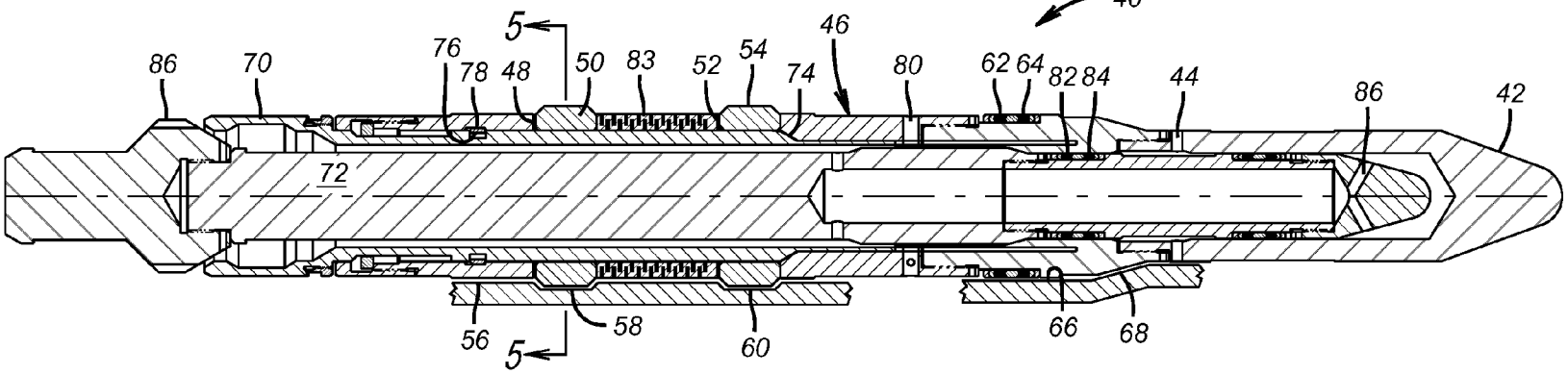
FIG. 4 shows the multi-row version of the lock mandrel tool in the dogs extended position.
Figure 5:
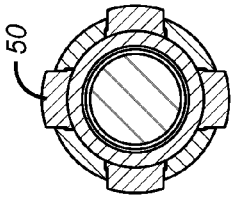
FIG. 5 is a view along lines 5-5 of FIG. 4

FIG. 4 shows the tool 40 with a nose 42 and a flow port 44 to allow fluid movement through the tool 40 during run in. A housing 46 has an upper row of openings or windows 48 disposed circumferentially in a predetermined pattern and in a quantity that space will allow. FIG. 5 shows four dogs circumferentially spaced at 90 degrees but other even or uneven spacing or number of windows 48 and dogs 50 can be used. A second row of windows 52 each having a radially extendable dog 54 is illustrated below windows 48 and dogs 50. More than two rows can be used and the windows 48 and 52 can be aligned or misaligned in the axial direction. The windows 48 and 52 and their corresponding dogs 50 and 54 can be identical in shape or volume or they can be different. A surrounding tubular 56 has profiles 58 and 60 to match the shape and size of the dogs 50 and 54. The spacing of the rows of dogs or the shape of the dogs and their mating profiles can be unique so that of more than one tool is to be located in a given tubular 56 at different locations each location can have a unique profile location using profiles such as 58 or 60.

The housing 46 also has seals 62 and 64 to align with a seal bore 66 that is just above the no-go 68 on the tubular 56. When the housing 46 hits the no go 68 the seals 62 and 64 line up with the seal bore 66 while the dogs 50 and 54 line up with the profiles 58 and 60. For initial run in the actuation sleeve 70 is supported by a running string that is not shown in FIG. 4. FIG. 4 shows a plug 72 that is later delivered in a separate trip as will be later explained. With the housing 46 landed on the no-go 68, setting down weight will first ramp out dogs 50 as they are engaged by taper 74 on the actuation sleeve 70 as a result of setting down weight on the running string that is not shown. The dogs 50 cam against the profile as they are extended picking the tool up off the no-go profile. Further setting down weight advances the taper 74 into contact with dogs 54 to radially extend them into their profile 60. A snap ring 76 jumps into groove 78 in the housing 46 after all the dogs 50 and 54 are forced radially out to hold the position of sleeve 70 with respect to the housing 46. Drill hole 80 allows attachment of the running tool, not shown, to the housing 46 via a shear wire, not shown. A port 44 allows for by-pass fluid to flow through the tool during run-in.

The objective of multiple rows is to reduce the stress on a given dog by having more dogs share the same loading. The issue when doing this in axially offset rows is that the machining tolerances of the windows 48 and 52 and the associated dogs 50 and 54 is such that advancing of the dogs 54 into profiles 60 can lift the dogs 50 in their profiles 58 because of the way the clearances play out to the point that dogs 50 carry no load or minimal load. This would defeat the purpose of the rows of dogs sharing the load. Accordingly, the present invention addresses this issue by providing axial flexibility between the rows of dogs. One way this is done is to take a section 83 between the rows of windows 48 and 52 and make it axially elastically flexible or/and elastically flexible in other planes or in torsion. What is illustrated is a series of circumferentially oriented elongated narrow openings that have opposed ends that are offset circumferentially from slots in an adjacent row. The rows can be equally or unequally spaced or the pattern can a spiral slot pattern as opposed to slots in a plane perpendicular to the longitudinal axis of the housing 46. Rather than slots, scores can be used in conjunction with slots or by themselves. A series of identical or differing openings can be used.

Section 83 in whole or in part can be made from a shape memory alloy (SMA) such as Nitinol®. SMAs will tolerate stretch for a predetermined distance at low modulus so that the load can be shared by the rows of dogs 50 and 54 without a failure of the part and with the ability to revert to the original dimension when the dogs are retracted. The section 83 can be a solid annular shape and its inherent properties will give it a spring-like quality within the anticipated amount of stretch envisioned when the dogs are extended so that they can share the load between or among rows.

Another concern is that the no-go 68 can receive a large load and fail if differential pressure loading puts the taper on the tool 40 against the no-go 68. One way to minimize or eliminate this risk is to use an SMA on the body in the region between the taper that is designed to initially land on the no-go 68 for extending the dogs 50 and 54. The run in dimension will properly position the dogs 50 and 54 to enter recesses 58 and 60. However after setting the tool 40 well fluids or another heat source can make that lower end of the tool 40 get shorter as it reverts to that length when the transition temperature for the SMA is crossed. This feature can be used regardless of whether there is a single row or multiple rows in the tool of FIG. 4 or FIG. 6.

Regardless of the approach the goal is to increase flexibility of the housing 46 between the rows of windows such as 48 and 52 so that radially extending one row of dogs will not cause the other row or rows of dogs to not take their share of the load. As previously explained this can happen when the spacing of the dogs 50 and 54 is axially off the spacing of the profiles 58 and 60 due to the various tolerances in the assembled tool 40. By providing the flexibility in the alignment process the result of sharing the load among multiple rows of dogs is achieved and each dog can then be designed for a smaller loading without reduction of the overall ability of the tool 40 to resist the targeted load.

The plug 72 with its seals 82 and 84 lands in the nose 42 on a separate trip. It has passages 86 to allow fluid flow during run in. Its upper end 86 is secured to the sleeve 70 by rotation or another way.

Figure 1:
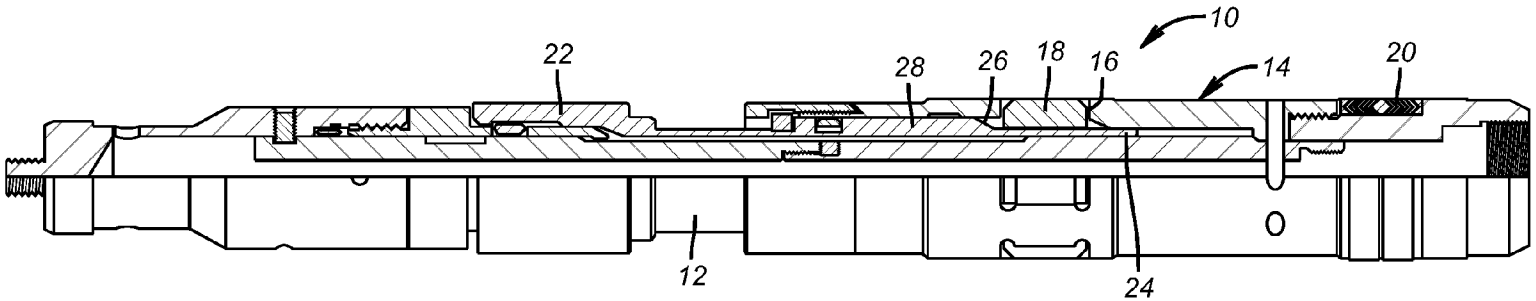
(PRIOR ART) FIG. 1
FIG. 1 is a run in configuration of a prior art lock mandrel tool.
Figure 2:
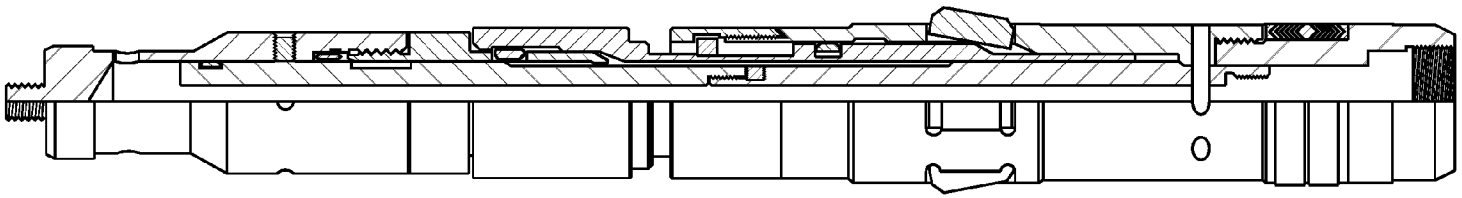
(PRIOR ART) FIG. 2
FIG. 2 is the view of FIG. 1 during the extension of the dogs.
Figure 3:
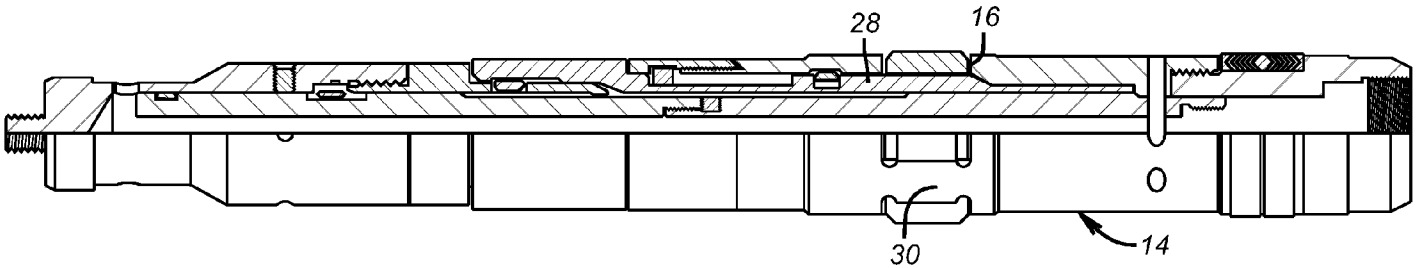
(PRIOR ART) FIG. 3
FIG. 3 is the view of FIG. 2 with the dogs fully extended.
Figure 6:
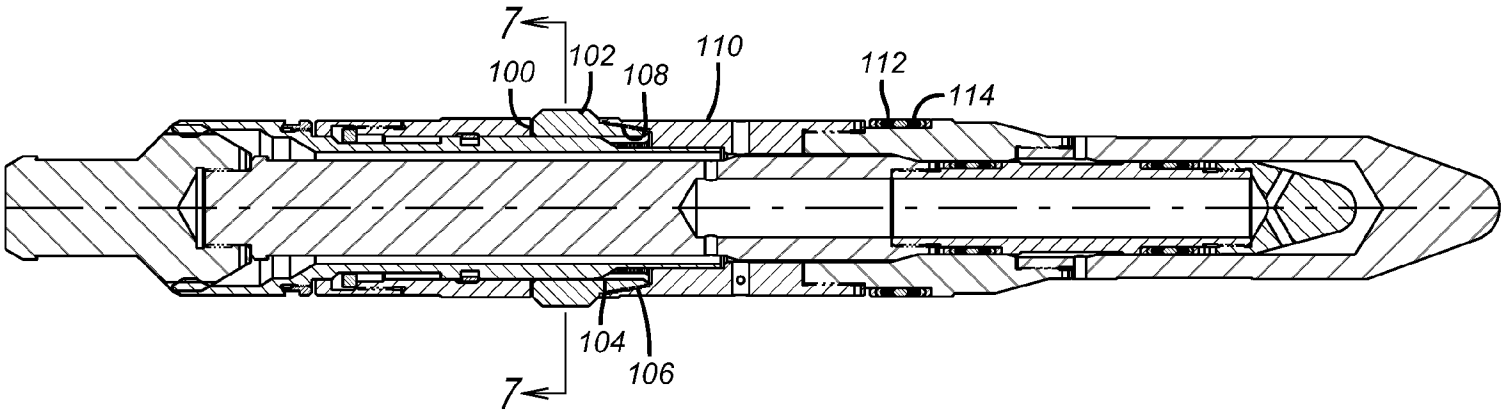
FIG. 6 shows the dogs having extensions that engage the housing on radial extension of the dogs to transfer stress from the housing to the extension and into a surrounding profile.
Figure 7:
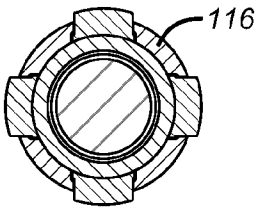
FIG. 7 is a view along lines 7-7 of FIG. 6.

FIGS. 6 and 7 show a single row of openings 100 through which a dog assembly 102 extends. Rather than having an internal flange to prevent overextension from housing 46 as is the case with the dogs 50 and 54, the dog assembly 102 in each window or at least some windows has an extension 104 that has a surface gripping profile 106 that matches a similar profile 108 on the housing 110. When the dog assemblies are pushed out radially in the same manner as in FIG. 5, the radial movement brings profiles 106 and 108 into an interlocking relationship when a shear load is applied due to differential pressure acting on seals when the housing 110 is no longer supported on a no-go of a surrounding tubular that is not shown for clarity in FIG. 6 but is the same as illustrated in FIG. 4. For example when there is a net pressure differential from above the dog assemblies 102 the result is a tensile force on the housing between the dogs 102 and the seals 112 and 114. Was it not for the engagement of the gripping profiles 106 and 108, which could be a series of ridges parallel to each other or a spiral thread form to name a few options, the stress can be communicated to the portions of the housing between the windows 100. This phenomenon was discussed earlier with regard to the FIGS. 1-3 embodiment with regard to segments 30 that have to be designed to take stress from differential pressure stresses. As previously explained this limited the size of the dogs 18 as there had to be enough body material left to take the stress communicated through it with the dogs 18 extending into their respective profiles.

However, in the FIG. 6 design the extensions 104 transfer the stress from a location on the housing 110 where there are no windows and through the dogs 102 and into the surrounding profile that is not shown in FIG. 6. Thus, the portion of the housing 110 that is between the windows 100, best seen as 116 in FIG. 7, is minimally stressed. This allows for windows 100 and their respective dogs 102 to be made larger for a greater capacity for stress while still reducing the extent of the wall areas at 116 as compared to the design of FIGS. 1-3 where the portions 30 are more severely stressed.

While FIG. 7 shows a single row, multiple rows as shown in FIG. 4 can be used with the feature of the extensions 104 also shown in FIG. 7. The flexible segment 82 would be located between rows as shown in FIG. 4. Combining the features allows the use of larger dogs and smaller spaces between windows in a given row with the feature of load sharing that is achieved from using multiple rows without the concern that one row will not adequately share the loading with dogs in another row.

Figure 8:
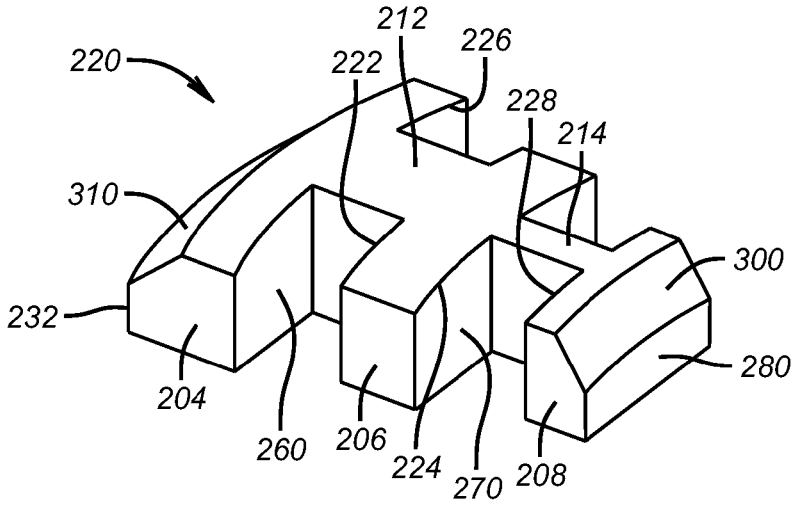
FIG. 8 is a view of an alternative embodiment of a load distributing dog design.
Figure 9:
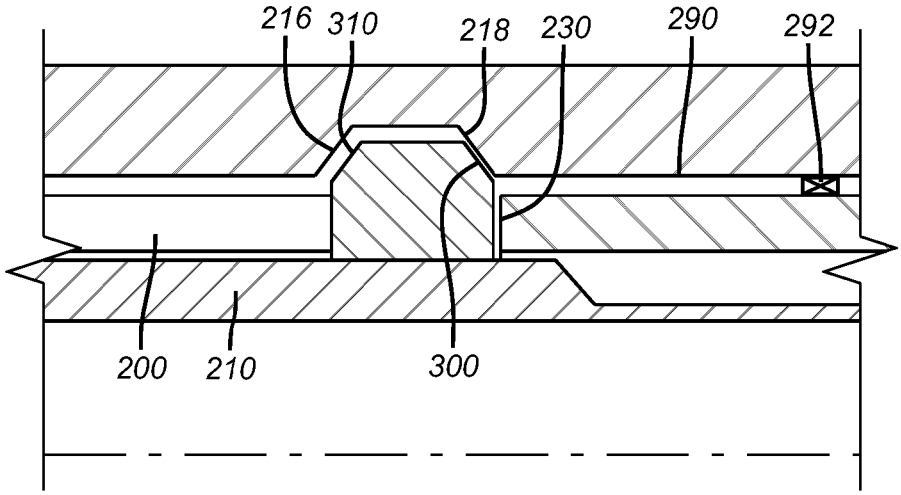
FIG. 9 is a section view showing the dog of FIG. 8 in a nipple profile.
Figure 10:
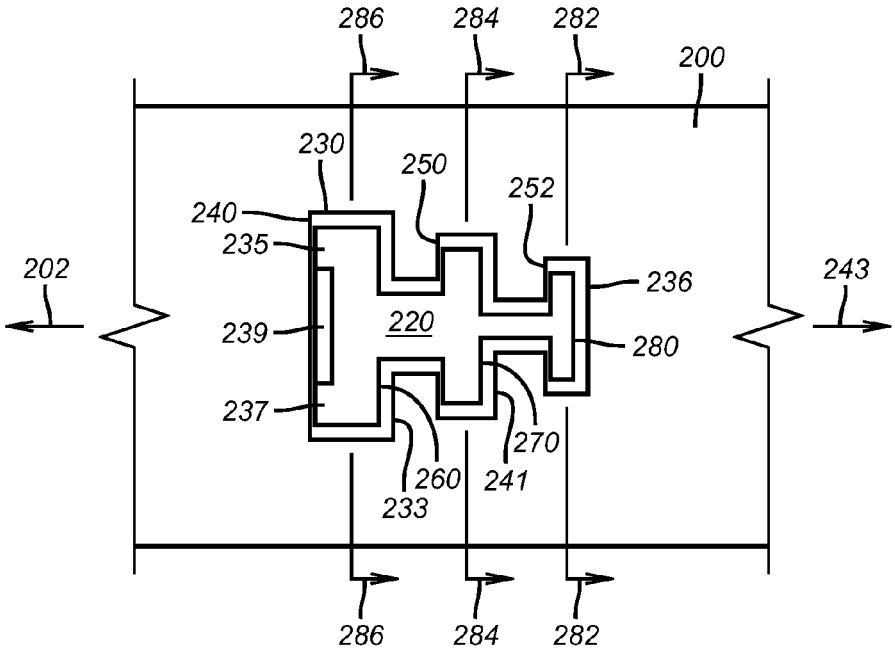
FIG. 10 is a top view of the dog of FIG. 8 extending through a matching pattern in the dog housing.
Figure 11:
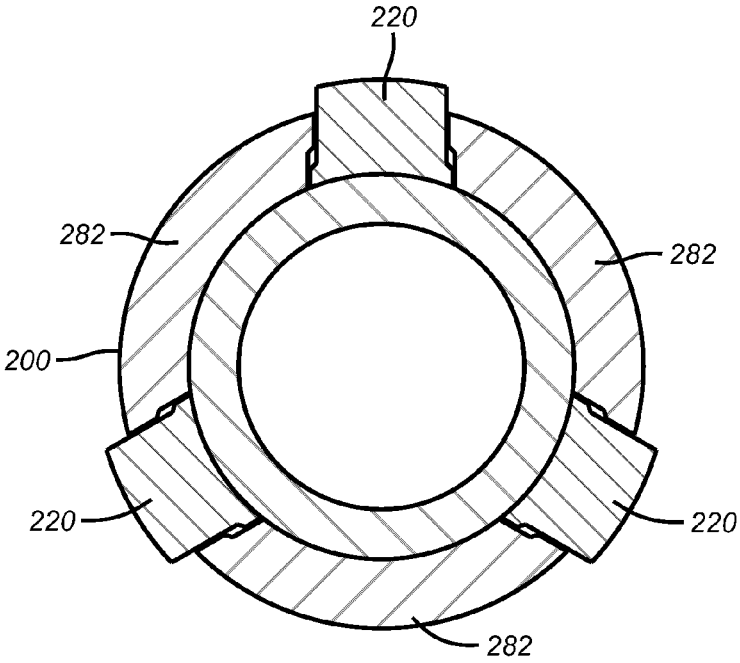
FIG. 11 is an alternative view of the dog of FIG. 8.

In another embodiment, shown in FIGS. 8-10 the dogs 220 extend into a nipple profile 290. Dogs 220 extend through a dog housing 200 and are driven out radially into the profile 290 by a ramped sleeve 210. The dogs 220 extend through a similarly shaped opening 230 in the dog housing 200 as seen in FIG. 10. As shown in FIG. 8 there are multiple generally parallel rows 204, 206 and 208 that are spaced apart using connecting segments 212 connecting 204 and 206 and 214 connecting 206 and 208. The end contact surfaces 310 and 300 are tapered to the angle of end surfaces 216 and 218 in the profile 290. Row 206 does not contact the profile 290 and has opposed parallel sides 222 and 224. Segments 204 and 208 have interior surfaces 226 and 228 respectively. Surface 226 is substantially parallel to surface 222 and surface 228 is substantially parallel to surface 224. Surface 232 on dogs 220 faces surface 240 on the opening 230 in housing 200. On the other end of the dogs 220, surface 234 faces surface 236 of opening 230 in housing 200.

The shape of the opening 230 is shown in more detail in FIG. 10. In the position shown there is differential loading on the housing 200 with the dogs 220 extended into the profile 290. As a result there are three loading surfaces on the housing 200 that are loaded by each dog 220 and those surfaces are 240, 250 and 252. Those surfaces are stressed by the following surfaces, respectively on each dog 220, when there is differential loading in the downhole direction on the housing 200 as represented by arrow 243: 232, 222 and 228. The dogs 220 are loaded in compression. Tension loading can result in necking that can lead to dog failure and possible loss of well control if the dogs 220 were retaining a well plug for example.

Note that the segments 204, 206 and 208 progressively reduce in length from 204 to 208. The sections 286, 284 and 282 of the housing 200 between the openings 230 correspondingly increase in width. Load 243 is applied to the housing below the dogs 220 at seal 292 so the full load is transmitted in tension through section 282 and all other sections between 282 and the seals 292. A portion of the load is transmitted through surface 252 into the dog 220, thus the amount of load that goes through housing section 284 is the remainder of the portion transmitted through surface 252 and total load 243. Likewise a portion of the load is transmitted to the dog 220 through surfaces 240 and 250 and thus housing section 286 carries the least load out of sections 282, 284 and 286. This apportions the load so the strongest of housing sections 282, 284 and 286 takes the most load. It should be noted that surface 232 has two disparate segments 235 and 237 separated by the recess 239 with the purpose being to bring the stressed areas on the dog closer to equivalence so as to more equally distribute stress among the three loaded surfaces 240, 250 and 252.

Load 243 transmitted to the dog 220 from the housing 200 occurs at surfaces 232, 222, and 228 and each portion is transmitted through the length of the dog between said surfaces and surface 300 where the load is transmitted to profile 290. Thus the portions of the dog 220 closer to surface 300 carry more load.

When the differential loading is in the uphole direction opposite arrow 202, surfaces 260, 270 and 280 are loaded by surfaces 233, 241 and 236. Section 282 and all other sections between section 282 and the seal 292 again transmit the load but in this case it is a compressive load.

The spacing of the loading surfaces 240, 250 and 252 can be even or uneven and the same is true for the load surfaces 232, 222 and 228 on the dogs 220. While three locations of load distribution are shown for each dog extending through a respective opening, other numbers of load distributing surface pairs can be employed within the scope of the invention.

Those skilled in the art will appreciate that multiple rows or other orientations of dogs can be provided and the issue of cumulative tolerances causing the insertion of one dog into its profile to move another dog out of a load carrying placement in its profile will be addressed with a flexibility feature in the housing among axially spaced dogs. The housing flexibility can be provided by selective weakening of the housing with slots or scores of a variety of shapes and regular or random patterns. Alternatively the material itself can change properties to provide the flexibility when extending the dogs in response to a stimulus such as well fluids, heat, pressure or various applied fields, to mention a few flexibility providing features. The housing material itself between the rows of dogs can be flexible as long as it can tolerate the stress imposed on dog extension and subsequent pressure differential loading when latched.

The above description is illustrative of the preferred embodiment and many modifications may be made by those skilled in the art without departing from the invention whose scope is to be determined from the literal and equivalent scope of the claims below:

We claim:

1. A latch tool for engaging a profile in a surrounding tubular in at least one subterranean location, comprising:

an elongated housing having a longitudinal axis and a plurality of openings through which dogs are selectively actuated to engage the profile in the tubular located outside said openings;

at least some of said dogs have an axial extension that moves within said housing and does not extend into said window and is disposed internally of said elongated housing at a location axially displaced from said windows, said extension further comprising a first gripping profile that faces a surrounding inwardly facing surface of said housing for selective contact therewith;

said housing having a second gripping profile on said inwardly facing surface adjacent and opposed to said first gripping profile such that extension of said dogs through their respective windows brings said gripping profiles into interlocking engagement for transmission of axial stress, said stress created from differential pressure on the latch tool from within the surrounding tubular that otherwise would transfer to said housing at said openings and instead direct said stress to said inwardly facing surface on said housing.

2. The tool of claim 1, wherein:

stress from said housing from said second gripping profile is communicated through said extension to said dog in the respective profile of said dog in the surrounding tubular to reduce stress on a portion of said housing between windows when said windows are arranged in at least one row.

3. The tool of claim 2, wherein:

said first and second profiles comprise a series of parallel ridges or a spiral layout.

4. The tool of claim 2, wherein:

said openings are axially spaced and said housing disposed in said axial spacing exhibits flexibility to assist in alignment of said dogs into the profile for sharing stress under load to said housing.

5. The tool of claim 4, wherein:

said windows are arranged in at least two rows with multiple windows in each row and each row being disposed in a discrete plane.

6. The tool of claim 4, wherein:

said windows are arranged in at least two rows with multiple windows in each row and each row being disposed in a discrete plane;

said planes are parallel to each other and perpendicular to said longitudinal axis.

7. A latch tool for engaging a profile in a surrounding tubular in at least one subterranean location, comprising:

an elongated housing having a longitudinal axis and a plurality of openings through which dogs are selectively actuated to engage the profile in the tubular;

at least some of said dogs have an extension that does not extend through said window and is disposed internally of said elongated housing at a location axially displaced from said windows, said extension further comprising a first gripping profile that faces an inside surface of said housing for selective contact therewith;

said housing having a second gripping profile on said inside surface adjacent and opposed to said first gripping profile such that extension of said dogs through their respective windows brings said gripping profiles into engagement for resistance to stress from differential pressure on the latch tool from within the surrounding tubular;

stress from said housing from said second gripping profile is communicated through said extension to said dog in the respective profile of said dog in the surrounding tubular to reduce stress on a portion of said housing between windows when said windows are arranged in at least one row;

said openings are axially spaced and said housing disposed in said axial spacing exhibits flexibility to assist in alignment of said dogs into the profile for sharing stress under load to said housing;

said housing in said axial spacing selectively axially lengthens or shortens.

8. The tool of claim 7, wherein:

said housing in said axial spacing has wall openings or scorings.

9. A latch tool for engaging a profile in a surrounding tubular in at least one subterranean location, comprising:

an elongated housing having a longitudinal axis and a plurality of openings through which dogs are selectively actuated to engage the profile in the tubular;

at least some of said dogs have an extension that does not extend through said window, said extension further comprising a first gripping profile;

said housing having a second gripping profile adjacent and opposed to said first gripping profile such that extension of said dogs through their respective windows brings said gripping profiles into engagement;

said housing comprises a taper to engage a no-go on the surrounding tubular to generally align said dogs with respective profiles in the surrounding tubular;

at least a portion of said housing, between said taper and the nearer of said openings made of a shape memory alloy that in a run in state aligns said dogs to respective profiles and when crossing the transition temperature for said alloy retracts said taper from said no-go to minimize or eliminate contact between said taper and said no go under loading of said housing.

* * * * *